US010977984B2

(12) United States Patent
Xuan et al.

(10) Patent No.: US 10,977,984 B2
(45) Date of Patent: Apr. 13, 2021

(54) PIXEL CIRCUIT AND DRIVING METHOD THEREOF, DISPLAY PANEL AND VIDEO WALL

(71) Applicant: BOE Technology Group Co., Ltd., Beijing (CN)

(72) Inventors: Minghua Xuan, Beijing (CN); Han Yue, Beijing (CN); Ming Yang, Beijing (CN); Ning Cong, Beijing (CN); Xiaochuan Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/448,913

(22) Filed: Jun. 21, 2019

(65) Prior Publication Data

US 2020/0035148 A1 Jan. 30, 2020

(30) Foreign Application Priority Data

Jul. 24, 2018 (CN) ..... 201810820707.5

(51) Int. Cl.
*G09G 3/32* (2016.01)
*G09G 3/3258* (2016.01)
(Continued)

(52) U.S. Cl.
CPC ..... *G09G 3/32* (2013.01); *G09G 3/3233* (2013.01); *G09G 3/3258* (2013.01);
(Continued)

(58) Field of Classification Search
CPC ..... G09G 3/32; G09G 3/3208; G09G 3/3225; G09G 3/3233; G09G 3/3258;
(Continued)

(56) References Cited

U.S. PATENT DOCUMENTS

2007/0063993 A1* 3/2007 Shishido ..... G09G 3/3241 345/175
2009/0021496 A1* 1/2009 Silzars ..... G09F 13/22 345/204
2017/0337874 A1* 11/2017 Toyomura ..... G09G 3/20

FOREIGN PATENT DOCUMENTS

CN 1928973 A 3/2007
CN 102460550 A 5/2012
(Continued)

OTHER PUBLICATIONS

First Office Action dated Dec. 9, 2019 corresponding to Chinese application No. 201810820707.5.

*Primary Examiner* — Jimmy H Nguyen
(74) *Attorney, Agent, or Firm* — Nath, Goldberg & Meyer; Joshua B. Goldberg

(57) ABSTRACT

The present application provides a pixel circuit and a method for driving the same, a display panel and a video wall. The pixel circuit includes a light emitting diode having a first electrode configured to receive a first power supply voltage and a second electrode configured to receive a second power supply voltage; and a switching sub-circuit having a first terminal electrically coupled to a display signal terminal, a second terminal electrically coupled to the second electrode of the light emitting diode and a control terminal electrically coupled to a scan signal terminal, and configured to control an emission state of the light emitting diode based on a display signal provided from the display signal terminal, in response to a scan signal provided from the scan signal terminal. The emission state varies based on a magnitude and a duration of an effective voltage level of the display signal.

7 Claims, 4 Drawing Sheets

(51) Int. Cl.

| | |
|---|---|
| ***G09G 3/3233*** | (2016.01) |
| ***G09G 3/3225*** | (2016.01) |
| ***G09G 3/3208*** | (2016.01) |
| *G09G 3/20* | (2006.01) |

(52) U.S. Cl.
CPC ..... *G09G 3/2011* (2013.01); *G09G 3/2014* (2013.01); *G09G 3/3208* (2013.01); *G09G 3/3225* (2013.01); *G09G 2300/026* (2013.01); *G09G 2300/0426* (2013.01); *G09G 2300/0809* (2013.01); *G09G 2320/064* (2013.01)

(58) Field of Classification Search
CPC ..... G09G 3/2011; G09G 3/2014; G09G 2300/0473; G09G 2300/0809; G09G 2300/0426; G09G 2300/026; G09G 2300/0819; G09G 2320/064
USPC ..... 345/39, 82, 76, 691, 1.1, 1.3
See application file for complete search history.

(56) References Cited

FOREIGN PATENT DOCUMENTS

| | | | |
|---|---|---|---|
| CN | 103680337 | A | 3/2014 |
| CN | 104575398 | A | 4/2015 |
| CN | 104700794 | A | 6/2015 |
| CN | 106991964 | A | 7/2017 |
| CN | 107038989 | A | 8/2017 |
| CN | 107039002 | A | 8/2017 |
| CN | 207217082 | U | 4/2018 |

* cited by examiner

PIXEL CIRCUIT AND DRIVING METHOD THEREOF, DISPLAY PANEL AND VIDEO WALL

CROSS-REFERENCE TO RELATED APPLICATION

This application claims priority to Chinese Patent Application No. 201810820707.5, filed on Jul. 24, 2018, the entire contents of which are hereby incorporated by reference.

TECHNICAL FIELD

The present disclosure relates to the field of display technology, and particularly, to a pixel circuit and a method for driving the same, a display panel and a video wall.

BACKGROUND

Compared to organic light emitting diodes (OLEDs), light emitting diodes have advantages such as high current-resistance, high brightness or the like and can be applied in display applications such as outdoor display, large display or the like.

The main peak of the emission spectrum of the LEDs may undergo offsets under different currents. Therefore, the pulse-width modulation (PWM) method is generally employed to perform passive matrix (PM) driving on the existing LED displays or LEDs.

SUMMARY

In an aspect, the present disclosure provides a pixel circuit, including a light emitting diode having a first electrode configured to receive a first power supply voltage and a second electrode configured to receive a second power supply voltage; and a switching sub-circuit having a first terminal electrically coupled to a display signal terminal, a second terminal electrically coupled to the second electrode of the light emitting diode and a control terminal electrically coupled to a scan signal terminal, and configured to control an emission state of the light emitting diode based on a display signal provided from the display signal terminal, in response to a scan signal provided from the scan signal terminal, wherein the emission state varies based on a magnitude and a duration of an effective voltage level of the display signal.

In some embodiments, the switching sub-circuit includes a switching transistor having a first electrode electrically coupled to the display signal terminal, a second electrode electrically coupled to the second electrode of the light emitting diode and a control electrode electrically coupled to the scan signal terminal.

In some embodiments, the pixel circuit further includes an emission control sub-circuit having a first terminal electrically coupled to the second electrode of the light emitting diode, a second terminal electrically coupled to a second power supply voltage terminal and a control terminal electrically coupled to the second terminal of the switching sub-circuit, and configured to couple a voltage provided from the second power supply voltage terminal as the second power supply voltage to the second electrode of the light emitting diode in response to the display signal.

In some embodiments, the emission control sub-circuit includes an emission control transistor having a first electrode electrically coupled to the second electrode of the light emitting diode, a second electrode electrically coupled to the second power supply voltage terminal and a control electrode electrically coupled to the second terminal of the switching sub-circuit.

In some embodiments, the pixel circuit further includes a reset sub-circuit having a first terminal electrically coupled to a restoration signal terminal, a second terminal electrically coupled to the second electrode of the light emitting diode and a control terminal electrically coupled to a reset signal terminal, and configured to couple a restoration signal provided from the restoration signal terminal to the second electrode of the light emitting diode in response to a reset signal provided from the reset signal terminal.

In some embodiment, the reset sub-circuit includes a reset transistor having a first electrode electrically coupled to the restoration signal terminal, a second electrode electrically coupled to the second electrode of the light emitting diode and a control electrode electrically coupled to the reset signal terminal.

In some embodiments, the light emitting diode is a mini light emitting diode.

In some embodiments, the first power supply voltage has a fixed high voltage level, and the second power supply voltage has a fixed low voltage level.

In another aspect, the present disclosure provides a method for driving a pixel circuit including a light emitting diode having a first electrode configured to receive a first power supply voltage and a second electrode configured to receive a second power supply voltage and a switching sub-circuit having a first terminal electrically coupled to a display signal terminal, a second terminal electrically coupled to the second electrode of the light emitting diode and a control terminal electrically coupled to a scan signal terminal, the method including turning on the switching sub-circuit through a scan signal provided from the scan signal terminal and controlling an emission state of the light emitting diode based on a display signal provided from the display signal terminal, wherein the emission state varies based on a magnitude and a duration of an effective voltage level of the display signal.

In some embodiments, the pixel circuit further includes an emission control sub-circuit having a first terminal electrically coupled to the second electrode of the light emitting diode, a second terminal electrically coupled to a second power supply voltage terminal and a control terminal electrically coupled to the second terminal of the switching sub-circuit, and controlling the emission state of the light emitting diode based on the display signal provided from the display signal terminal includes controlling a duration during which the emission control sub-circuit is in on state based on the display signal to control the emission state of the light emitting diode.

In some embodiments, the pixel circuit further includes a reset sub-circuit having a first terminal electrically coupled to a restoration signal terminal, a second terminal electrically coupled to the second electrode of the light emitting diode and a control terminal electrically coupled to a reset signal terminal, and the method further includes: turning on the reset sub-circuit through a reset signal provided from the reset signal terminal and coupling a restoration signal provided from the restoration signal terminal to the second electrode of the light emitting diode to reset the light emitting diode.

In some embodiments, the light emitting diode is a mini light emitting diode.

In some embodiments, the first power supply voltage has a fixed high voltage level, and the second power supply voltage has a fixed low voltage level.

In another aspect, the present disclosure further provides a pixel circuit, including a switching transistor, an emission control transistor, a reset transistor and a light emitting diode, wherein the switching transistor has a first electrode electrically coupled to a display signal terminal, a second electrode electrically coupled to a second electrode of the light emitting diode and a control electrode electrically coupled to a scan signal terminal; the emission control transistor has a first electrode electrically coupled to the second electrode of the light emitting diode, a second electrode electrically coupled to a second power supply voltage terminal and a control electrode electrically coupled to the second electrode of the switching transistor; the reset transistor has a first electrode electrically coupled to a restoration signal terminal, a second electrode electrically coupled to the second electrode of the light emitting diode and a control electrode electrically coupled to a reset signal terminal; and the light emitting diode has a first electrode electrically coupled to a first power supply voltage terminal and the second electrode electrically coupled to the first electrode of the emission control transistor and the second electrode of the reset transistor, wherein the switching transistor is configured to control an emission state of the light emitting diode based on a display signal provided from the display signal terminal, in response to a scan signal provided from the scan signal terminal, and wherein the emission state varies based on a magnitude and a duration of an effective voltage level of the display signal.

In some embodiments, the emission control transistor is configured to couple a voltage provided from the second power supply voltage terminal as a second power supply voltage to the second electrode of the light emitting diode in response to the display signal.

In some embodiments, the reset transistor is configured to couple a restoration signal provided from the restoration signal terminal to the second electrode of the light emitting diode in response to a reset signal provided from the reset signal terminal.

In another aspect, the present disclosure further provides a display panel, including a plurality of scan lines and a plurality of display signal lines intersecting each other, and a plurality of pixel units defined by intersections of the plurality of scan lines and the plurality of display signal lines, the plurality of pixel units being arranged in an array having rows and columns, and each of the plurality of pixel units having a pixel circuit provided therein, wherein the pixel circuit is any one of the pixel circuits described herein, wherein switching sub-circuits of a same row of pixel circuits of the plurality of pixel units are electrically coupled to a same scan line of the plurality of scan lines, and switching sub-circuits of a same column of pixel circuits of the plurality of pixel units are electrically coupled to a same display signal line of the plurality of display signal lines.

In some embodiments, the display panel further includes a glass substrate, and pixel circuits of the plurality of pixel units are provided on the glass substrate.

In some embodiments, the light emitting diode is a mini light emitting diode.

In another aspect, the present disclosure further provides a video wall formed by a plurality of display panels spliced together, wherein each of the plurality of display panels is any one of the display panels described herein.

DETAILED DESCRIPTION

To make those skilled in the art better understand the technical solutions of the present disclosure, the present disclosure will be described in detail below in conjunction with accompanying drawings and specific embodiments.

The main peak of the emission spectrum of the LEDs may undergo offsets under different currents. Therefore, the pulse-width modulation (PWM) method is generally employed to perform passive matrix (PM) driving on the existing LED displays or LEDs. However, when the PM driving is applied to a display having high resolution and large size, a large number of signal lines are required, such that the narrow bezel design of the display panel can hardly be achieved.

Accordingly, the present disclosure provides, inter alia, a pixel circuit and a method for driving the same, a display panel and a video wall that substantially obviate one or more of the problems due to limitations and disadvantages of the related art.

The transistor as described herein may refer to a thin film transistor or a field-effect transistor or other devices having similar characteristics. As the source and the drain of the employed transistor may be exchangeable in certain conditions, the descriptions in terms of the connection relationships are identical for the source and the drain. In embodiments of the present discourse, to distinguish the source and the drain of the transistor, one of them may be referred to as a first electrode and the other one may be referred to as a second electrode and the gate may be referred to as a control electrode. In addition, the transistors may be classified into an N-type transistor or a P-type transistor according to their characteristics. In the following embodiments, the transistor is described as a P-type transistor as an example. In a case where a P-type transistor is employed, the first electrode of the P-type transistor may be the source of the P-type transistor, the second electrode of the P-type transistor may be the drain of the P-type transistor, and the source and the drain are electrically connected when the gate of the P-type transistor receives a low voltage level, reverse rules apply to the N-type transistor. It is conceivable that embodiments in which the transistor is an N-type transistor are readily conceived by those skilled in the art without any creative efforts, and thus belong to the protection scope of the present disclosure.

The light emitting diode employed in the embodiments of the present disclosure may be a mini light emitting diode (mini LED). One of the first and second electrodes of the light emitting diode is a cathode and the other one is an anode. In the embodiments of the present disclosure, the descriptions are made by taking that the first electrode is an anode and the second electrode is a cathode as an example.

Figure 1:
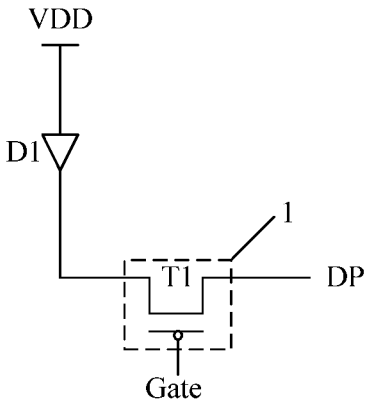
FIG. 1 is a schematic diagram illustrating a pixel circuit according to an embodiment of the present disclosure.

In an aspect, the present disclosure provides a pixel circuit. FIG. 1 is a schematic diagram illustrating a pixel circuit according to an embodiment of the present disclosure. As illustrated in FIG. 1, the pixel circuit in some embodiments includes a light emitting diode D1 and a switching sub-circuit 1. The light emitting diode D1 has a first electrode (e.g., an anode) and a second electrode (e.g., a cathode). The first electrode of the light emitting diode D1 is configured to receive a first power supply voltage and the second electrode thereof is configured to receive a second power supply voltage. The switching sub-circuit 1 has a first terminal electrically coupled to a display signal terminal DP, a second terminal electrically coupled to the second electrode of the light emitting diode D1 and a control terminal electrically coupled to a scan signal terminal Gate, and is configured to control, in response to a scan signal provided from the scan signal terminal Gate, an emission state of the light emitting diode D1 by controlling the second power supply voltage received by the second electrode of the light emitting diode D1 using a display signal provided from the display signal terminal DP. Optionally, the pixel circuit is a glass-based pixel circuit. That is, the pixel circuit may be fabricated on a glass substrate rather than on a printed circuit board (PCB). Optionally, the emission state varies based on a magnitude and a duration of an effective voltage level of the display signal. In some embodiments, the emission state includes brightness and grayscale, and the brightness and the grayscale vary based on the magnitude and the duration of the effective voltage level of the display signal.

In the present disclosure, the term "electrically coupled to" may refer to one element being directly coupled to another element (i.e., there is no intermediate element between the two elements) or one element being indirectly coupled to another element (i.e., there is an intermediate element intervening between the two elements).

The present pixel circuit includes the switching sub-circuit 1, when the present pixel circuit is applied to a display panel including pixel circuits in rows and columns, (the scan signal terminals of) the switching sub-circuits 1 of a same row of pixel circuits may be electrically coupled to a same scan line and (the display signal terminals of) the switching sub-circuits 1 of a same column of pixel circuits may be electrically coupled to a same display signal line. As such, the switching sub-circuits in a same row of pixel circuits are controlled to be turned on by progressively inputting scan signals to the scan lines, and then the emission state of the light emitting diode D1 in the pixel circuit coupled to a display signal line is controlled based on the display signal input to the display signal line. Compared to the driving manner of the light emitting diodes in the existing display panel, the wirings can be reduced by applying the present pixel circuit in the display panel, such that the narrow bezel design of the display panel can be achieved. Further, the display panel using the present pixel circuit can be applied to a video wall, thereby achieving a panel having large size and high resolution.

The present pixel circuit may be driven by employing the following driving method including: turning on the switching sub-circuit 1 through a scan signal and controlling the emission state of the light emitting diode D1 based on a display signal input to the switching sub-circuit 1.

In some embodiments, as illustrated in FIG. 1, the switching sub-circuit 1 of the pixel circuit may be a switching transistor T1 having a first electrode (e.g., a source) electrically coupled to the display signal terminal DP, a second electrode (e.g., a drain) electrically coupled to the second electrode of the light emitting diode D1 and a control electrode (e.g., a gate) electrically coupled to the scan signal terminal Gate.

In an example, when a low voltage level signal is input to the scan signal terminal Gate, the switching transistor T1 is turned on. At this time, the display signal input to the display signal terminal DP can be input to the second electrode of the light emitting diode D1, that is, the display signal is used as the second power supply voltage to control the light emitting diode D1 to emit light. Meanwhile, a timing control sub-circuit (not shown in figures) may be used to control the duration of the effective voltage level of the display signal, and the magnitude of the effective voltage level of the display signal may be controlled, so as to control the brightness and the grayscale displayed by the light emitting diode. As used herein, the term "effective voltage level" may refer to a voltage level enabling the light emitting diode D1 to emit light, or may refer to a voltage level turning on the transistor as described later.

Figure 2:
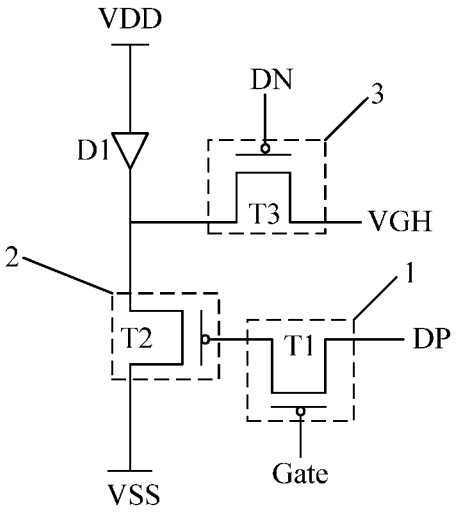
FIG. 2 is a schematic diagram illustrating a pixel circuit according to an embodiment of the present disclosure.

FIG. 2 is a schematic diagram illustrating a pixel circuit according to an embodiment of the present disclosure. As illustrated in FIG. 2, in addition to the switching sub-circuit 1 and the light emitting diode D1, the pixel circuit in some embodiments may further include an emission control sub-circuit 2 having a first terminal electrically coupled to the second electrode of the light emitting diode D1, a second terminal electrically coupled to a second power supply voltage terminal VSS and a control terminal electrically coupled to the second terminal of the switching sub-circuit 1, and configured to couple a voltage provided from the second power supply voltage terminal VSS as the second power supply voltage to the second electrode of the light emitting diode D1 in response to the display signal.

In a case where the pixel circuit includes the emission control sub-circuit 2, the method for driving the pixel circuit may further include controlling a duration during which the emission control sub-circuit 2 is in on state based on the display signal to control the emission state of the light emitting diode D1.

As illustrated in FIG. 2, the emission control sub-circuit 2 in some embodiments may include an emission control transistor T2 having a first electrode (e.g., a source) electrically coupled to the second electrode of the light emitting diode D1, a second electrode (e.g., a drain) electrically coupled to the second power supply voltage terminal VSS and a control electrode (e.g., a gate) electrically coupled to the second terminal of the switching sub-circuit 1. When the switching sub-circuit 1 is turned on and the display signal is a low voltage level signal, the emission control transistor T2 is turned on. At the same time, the second power supply voltage provided from the second power supply voltage terminal VSS may be transmitted to the second electrode of the light emitting diode D1 through the emission control transistor T2 to cause the light emitting diode D1 to emit light. In this case, the duration of the effective voltage level (i.e., a low voltage level) of the display signal may also be controlled by the timing control sub-circuit to control the duration during which the second power supply voltage is input to the second electrode of the light emitting diode D1, such that the grayscale displayed by the light emitting diode D1 is controlled. Meanwhile, the magnitude of the effective voltage level of the display signal may be controlled to control the brightness of the light emitting diode D1.

As illustrated in FIG. 2, the pixel circuit in some embodiments may further include a reset sub-circuit 3 having a first terminal electrically coupled to a restoration signal terminal VGH, a second terminal electrically coupled to the second electrode of the light emitting diode D1 and a control terminal electrically coupled to a reset signal terminal DN, and configured to couple a restoration signal provided from the restoration signal terminal VGH to the second electrode of the light emitting diode D1 in response to a reset signal provided from the reset signal terminal DN.

In a case where the pixel circuit includes the reset sub-circuit 3, the method for driving the pixel circuit may further include turning on the reset sub-circuit 3 through a reset signal provided from the reset signal terminal DN and resetting the light emitting diode D1 through a restoration signal provided from the restoration signal terminal VGH.

In some embodiments, as illustrated in FIG. 2, the reset sub-circuit 3 may include a reset transistor T3 having a first electrode (e.g., a source) electrically coupled to the restoration signal terminal VGH, a second electrode (e.g., a drain) electrically coupled to the second electrode of the light emitting diode D1 and a control electrode (e.g., a gate) electrically coupled to the reset signal terminal DN. In this case, when the reset signal input from the reset signal terminal DN is a low voltage level signal, the reset transistor T3 is turned on. As such, the restoration signal input to the restoration signal terminal VGH is transmitted to the second electrode of the light emitting diode D1 to restore the light emitting diode D1 to not emit light. Here, the restoration signal input to the restoration signal terminal VGH should be higher than or equal to the first power supply voltage received from a first power supply voltage terminal VDD to ensure the reverse bias of the light emitting diode D1 in a restoration stage to not emit light, thereby realizing the restoration.

Accordingly, the pixel circuit further includes the first power supply voltage terminal VDD configured to provide a first power supply voltage and electrically coupled to the first electrode of the light emitting diode D1. In this case, when the first power supply voltage received from the first power supply voltage terminal VDD is higher than the second power supply voltage received from the second power supply voltage terminal VSS, the light emitting diode D1 may emit light. Optionally, the first power supply voltage has a fixed high voltage level, and the second power supply voltage has a fixed low voltage level.

Next, the pixel circuit according to an embodiment of the present disclosure will be described in detail with reference to FIG. 2. As illustrated in FIG. 2, the pixel circuit in some embodiments may include a switching transistor T1, an emission control transistor T2, a reset transistor T3 and a light emitting diode D1. The switching transistor T1 has a first electrode electrically coupled to a display signal terminal DP, a second electrode electrically coupled to a control electrode of the emission control transistor T2 and a control electrode electrically coupled to a scan signal terminal Gate. The emission control transistor T2 has a first electrode electrically coupled to a second electrode of the light emitting diode D1, a second electrode electrically coupled to a second power supply voltage terminal VSS and the control electrode electrically coupled to the second electrode of the switching transistor T1. The reset transistor T3 has a first electrode electrically coupled to a restoration signal terminal VGH, a second electrode electrically coupled to the second electrode of the light emitting diode D1 and a control electrode electrically coupled to a reset signal terminal DN. The light emitting diode D1 has a first electrode electrically coupled to a first power supply voltage terminal VDD and the second electrode electrically coupled to the first electrode of the emission control transistor T2 and the second electrode of the reset transistor T3.

The pixel circuit includes the switching transistor T1, the emission control transistor T2, the reset transistor T3 and the light emitting diode D1, when the present pixel circuit is applied to a display panel including pixel circuits in rows and columns, the control electrodes of the switching transistor T1 of a same row of pixel circuits may be electrically coupled to a same scan line, the first electrodes of the switching transistor T1 of a same column of pixel circuits may be electrically coupled to a same display signal line, the control electrodes of the reset transistors T3 of a same row of pixel circuits may be electrically coupled to a same reset signal line, and first electrodes of reset transistors T3 of a same column of pixel circuits may be electrically coupled to a same restoration signal line. As such, the switching transistors T1 in a same row of pixel circuits are controlled to be turned on by progressively inputting scan signals to the scan lines, and the emission state of the light emitting diode D1 in the pixel circuit coupled to a display signal line is controlled based on the display signal input to the display signal line. Similarly, the reset transistors T3 in a same row of pixel circuits may be controlled to be turned on by progressively inputting reset signals to the reset signal lines, and the light emitting diode D1 coupled to a restoration signal line is restored through the restoration signal input to the restoration signal line so as not to emit light. Compared to the driving manner of the light emitting diodes in the existing display panel, the wirings can be reduced by applying the present pixel circuit in the display panel, such that the narrow bezel design of the display panel can be achieved. Further, the display panel using present pixel circuit can be applied to a video wall, thereby achieving a panel with large size and high resolution.

Figure 3:
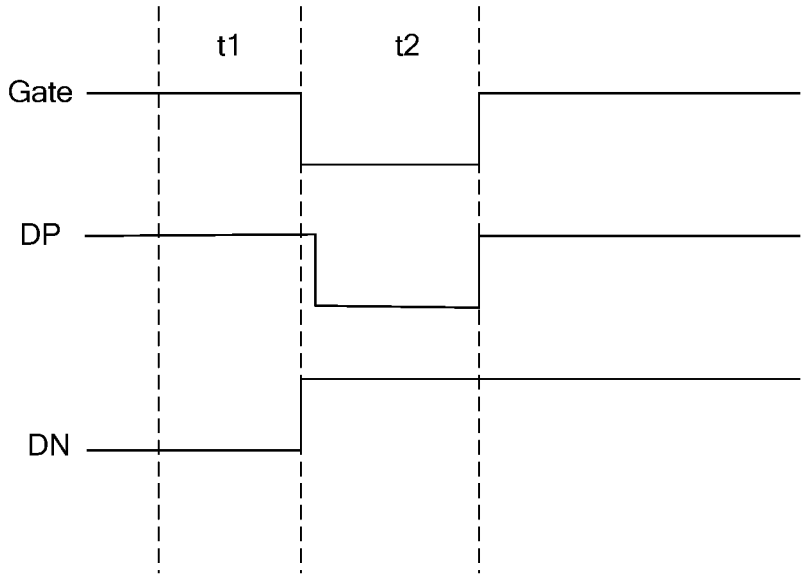
FIG. 3 is a timing sequence of an operation of the pixel circuit in FIG. 2.

FIG. 3 is a timing sequence of an operation of the pixel circuit in FIG. 2. Next, a method for driving the pixel circuit described herein will be described in detail with reference to FIGS. 2 and 3. In some embodiments, the method may include a reset stage (t1) and an emission stage (t2).

In the reset stage (t1), a low voltage level signal is input to the reset signal terminal DN, the reset transistor T3 is turned on, and the restoration signal (which is a high voltage level signal and higher than the first power supply voltage applied to the first electrode of the light emitting diode D1) input to the restoration signal terminal VGH is transmitted to the second electrode of the light emitting diode D1 to cause the light emitting diode D1 not to emit light.

In the emission stage (t2), a low voltage level signal is input to the scan signal terminal Gate, the switching transistor T1 is turned on, and a low voltage level signal input to the display signal terminal DP is transmitted to the control electrode of the emission control transistor T2. At this time, the emission control transistor T2 is turned on and the second power supply voltage from the second power supply voltage terminal VSS is transmitted to the second electrode of the light emitting diode D1. As such, the light emitting diode D1 emits light under the control of the voltage difference between the first power supply voltage and the second power supply voltage (which is lower than the first power supply voltage). In some embodiments, by setting a relatively large voltage difference between the first power supply voltage and the second power supply voltage, a relatively high brightness can be achieved.

Figure 4:
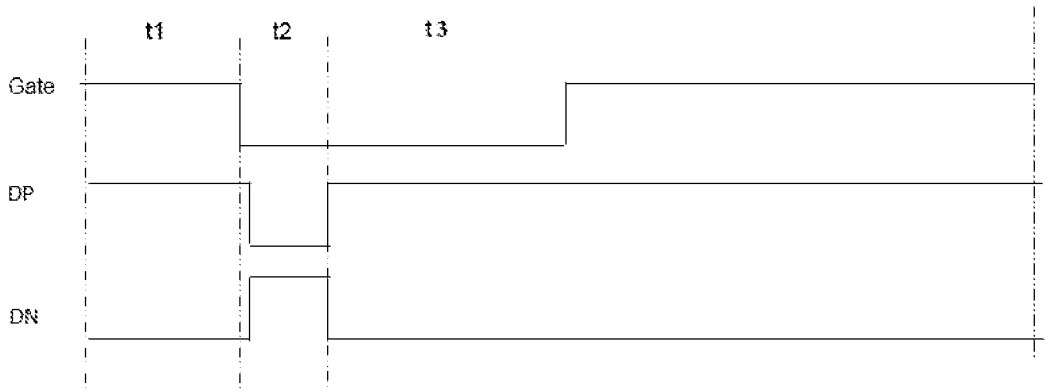
FIG. 4 is another timing sequence of an operation of the pixel circuit in FIG. 2

FIG. 4 is another timing sequence of an operation of the pixel circuit in FIG. 2. Next, a method for driving the pixel circuit described herein will be described in detail with reference to FIGS. 2 and 4. In some embodiments, the method may include a reset stage (t1), an emission stage (t2) and a L0 grayscale maintain stage (t3).

In the reset stage (t1), a low voltage level signal is input to the reset signal terminal DN, the reset transistor T3 is turned on, and the restoration signal (which is a high voltage level signal and higher than the first power supply voltage applied to the first electrode of the light emitting diode D1) input to the restoration signal terminal VGH is transmitted to the second electrode of the light emitting diode D1 to cause the light emitting diode D1 not to emit light.

In the emission stage (t2), a high voltage level signal is input to the reset signal terminal DN, the reset transistor T3 is turned off, and at the same time a low voltage level signal is input to the scan signal terminal Gate, the switching transistor T1 is turned on, and a low voltage level signal from the display signal terminal DP is transmitted to the control electrode of the emission control transistor T2 through the switching transistor T1. At this time, the emission control transistor T2 is turned on, and the second the second power supply voltage from the second power supply voltage terminal VSS is transmitted to the second electrode of the light emitting diode D1. As such, the light emitting diode D1 emits light under the control of the voltage difference between the first power supply voltage and the second power supply voltage (which is lower than the first power supply voltage). In some embodiments, by setting a relatively large voltage difference between the first power supply voltage and the second power supply voltage, a relatively high brightness can be achieved.

In the L0 grayscale maintain stage (t3), a low voltage level is input to the scan signal terminal Gate, and the emission control transistor T2 is turned off as a high voltage level signal is input to the display signal terminal DP. Meanwhile, a low voltage level signal is input to the reset signal terminal DN, so that the restoration signal input to the restoration signal terminal VGH is transmitted to the second electrode of the light emitting diode D1 to ensure that the light emitting diode D1 is reversely biased and does not emit light.

As described above, the duration (i.e., effective time) of the effective voltage level of the display signal may be controlled by the timing control sub-circuit, and the magnitude of the effective voltage level of the display signal may be controlled (e.g., by a controller), so as to control the displayed brightness and grayscale of the light emitting diode D1. Here, by controlling the pulse width (i.e., effective time) of the low voltage level signal input from the display signal terminal DP in the emission stage, different grayscales of the light emitting diode D1 can be achieved. It has been discovered in the present disclosure that there is a correspondence between the effective time (microsecond (μs)) and the grayscales of L1 to L256. In addition, to achieve the grayscale of L0 of the light emitting diode D1, the display signal input from the display signal terminal DP in the emission stage may be controlled to be at a high voltage level, such that the emission control transistor T2 is turned off. At the same time, the reset signal terminal DN is controlled to input a low voltage level signal to turn on the reset transistor T3 and then a high voltage level signal input to the restoration signal terminal VGH is transmitted to the second electrode of the light emitting diode D1, such that the light emitting diode D1 is reversely biased and does not emit light.

TABLE 1 correspondence between the effective time (T in microsecond (μs)) and the grayscales (L)

| L | T | L | T | L | T | L | T | L | T | L | T | L | T | L | T |
|---|---|---|---|---|---|---|---|---|---|---|---|---|---|---|---|
| 1 | 0.01 | 33 | 24.51 | 65 | 108.90 | 97 | 262.73 | 129 | 491.94 | 161 | 801.00 | 193 | 1193.55 | 225 | 1672.70 |
| 2 | 0.05 | 34 | 26.17 | 66 | 112.62 | 98 | 268.73 | 130 | 500.37 | 162 | 811.99 | 194 | 1207.20 | 226 | 1689.10 |
| 3 | 0.13 | 35 | 27.90 | 67 | 116.41 | 99 | 274.80 | 131 | 508.88 | 163 | 823.06 | 195 | 1220.93 | 227 | 1705.58 |
| 4 | 0.24 | 36 | 29.68 | 68 | 120.26 | 100 | 280.94 | 132 | 517.46 | 164 | 834.20 | 196 | 1234.75 | 228 | 1722.16 |
| 5 | 0.39 | 37 | 31.53 | 69 | 124.19 | 101 | 287.16 | 133 | 526.13 | 165 | 845.44 | 197 | 1248.65 | 229 | 1738.82 |
| 6 | 0.58 | 38 | 33.43 | 70 | 128.18 | 102 | 293.45 | 134 | 534.87 | 166 | 856.75 | 198 | 1262.64 | 230 | 1755.57 |
| 7 | 0.81 | 39 | 35.40 | 71 | 132.25 | 103 | 299.82 | 135 | 543.69 | 167 | 868.15 | 199 | 1276.71 | 231 | 1772.40 |
| 8 | 1.08 | 40 | 37.42 | 72 | 136.38 | 104 | 306.26 | 136 | 552.59 | 168 | 879.62 | 200 | 1290.87 | 232 | 1789.33 |
| 9 | 1.41 | 41 | 39.51 | 73 | 140.58 | 105 | 312.78 | 137 | 561.57 | 169 | 891.18 | 201 | 1305.11 | 233 | 1806.34 |
| 10 | 1.77 | 42 | 41.66 | 74 | 144.85 | 106 | 319.37 | 138 | 570.62 | 170 | 902.83 | 202 | 1319.44 | 234 | 1823.44 |
| 11 | 2.19 | 43 | 43.88 | 75 | 149.19 | 107 | 326.03 | 139 | 579.76 | 171 | 914.55 | 203 | 1333.85 | 235 | 1840.63 |
| 12 | 2.65 | 44 | 46.15 | 76 | 153.61 | 108 | 332.77 | 140 | 588.98 | 172 | 926.36 | 204 | 1348.35 | 236 | 1857.90 |
| 13 | 3.16 | 45 | 48.49 | 77 | 158.09 | 109 | 339.59 | 141 | 598.27 | 173 | 938.25 | 205 | 1362.93 | 237 | 1875.26 |
| 14 | 3.72 | 46 | 50.90 | 78 | 162.64 | 110 | 346.48 | 142 | 607.65 | 174 | 950.22 | 206 | 1377.60 | 238 | 1892.72 |
| 15 | 4.33 | 47 | 53.36 | 79 | 167.26 | 111 | 353.45 | 143 | 617.10 | 175 | 962.28 | 207 | 1392.36 | 239 | 1910.26 |
| 16 | 4.99 | 48 | 55.89 | 80 | 171.95 | 112 | 360.49 | 144 | 626.63 | 176 | 974.42 | 208 | 1407.20 | 240 | 1927.88 |
| 17 | 5.70 | 49 | 58.49 | 81 | 176.72 | 113 | 367.61 | 145 | 636.25 | 177 | 986.64 | 209 | 1422.13 | 241 | 1945.60 |
| 18 | 6.46 | 50 | 61.14 | 82 | 181.55 | 114 | 374.81 | 146 | 645.94 | 178 | 998.94 | 210 | 1437.14 | 242 | 1963.41 |
| 19 | 7.28 | 51 | 63.87 | 83 | 186.46 | 115 | 382.08 | 147 | 655.71 | 179 | 1011.33 | 211 | 1452.24 | 243 | 1981.30 |
| 20 | 8.14 | 52 | 66.65 | 84 | 191.44 | 116 | 389.42 | 148 | 665.57 | 180 | 1023.80 | 212 | 1467.42 | 244 | 1999.28 |
| 21 | 9.07 | 53 | 69.51 | 85 | 196.49 | 117 | 396.85 | 149 | 675.50 | 181 | 1036.36 | 213 | 1482.69 | 245 | 2017.35 |
| 22 | 10.04 | 54 | 72.42 | 86 | 201.61 | 118 | 404.35 | 150 | 685.51 | 182 | 1048.99 | 214 | 1498.05 | 246 | 2035.51 |
| 23 | 11.08 | 55 | 75.41 | 87 | 206.80 | 119 | 411.93 | 151 | 695.61 | 183 | 1061.72 | 215 | 1513.49 | 247 | 2053.76 |
| 24 | 12.16 | 56 | 78.46 | 88 | 212.07 | 120 | 419.58 | 152 | 705.78 | 184 | 1074.52 | 216 | 1529.02 | 248 | 2072.10 |
| 25 | 13.31 | 57 | 81.57 | 89 | 217.41 | 121 | 427.31 | 153 | 716.04 | 185 | 1087.41 | 217 | 1544.64 | 249 | 2090.52 |
| 26 | 14.51 | 58 | 84.75 | 90 | 222.82 | 122 | 435.12 | 154 | 726.38 | 186 | 1100.38 | 218 | 1560.34 | 250 | 2109.04 |
| 27 | 15.76 | 59 | 88.00 | 91 | 228.30 | 123 | 443.00 | 155 | 736.79 | 187 | 1113.44 | 219 | 1576.13 | 251 | 2127.64 |
| 28 | 17.08 | 60 | 91.32 | 92 | 233.86 | 124 | 450.97 | 156 | 747.29 | 188 | 1126.58 | 220 | 1592.01 | 252 | 2146.33 |
| 29 | 18.45 | 61 | 94.70 | 93 | 239.49 | 125 | 459.01 | 157 | 757.87 | 189 | 1139.81 | 221 | 1607.97 | 253 | 2165.12 |
| 30 | 19.87 | 62 | 98.15 | 94 | 245.19 | 126 | 467.12 | 158 | 768.53 | 190 | 1153.12 | 222 | 1624.02 | 254 | 2183.99 |
| 31 | 21.36 | 63 | 101.66 | 95 | 250.96 | 127 | 475.32 | 159 | 779.27 | 191 | 1166.51 | 223 | 1640.16 | 255 | 2202.95 |
| 32 | 22.91 | 64 | 105.25 | 96 | 256.81 | 128 | 483.59 | 160 | 790.10 | 192 | 1179.99 | 224 | 1656.39 | 256 | 2222.00 |

As shown in Table 1, the pulse width (i.e., effective time) of the low voltage level signal input from the display signal terminal DP in the emission stage corresponds to the grayscale. For example, the longer the effective time, the higher the grayscale, and the shorter the effective time, the lower the gray scale. For example, in a case where the effective time is 0.01 μs, the grayscale of L1 can be achieved, and in a case where the effective time is 2222 μs, the grayscale of L256 can be achieved.

Figure 5:
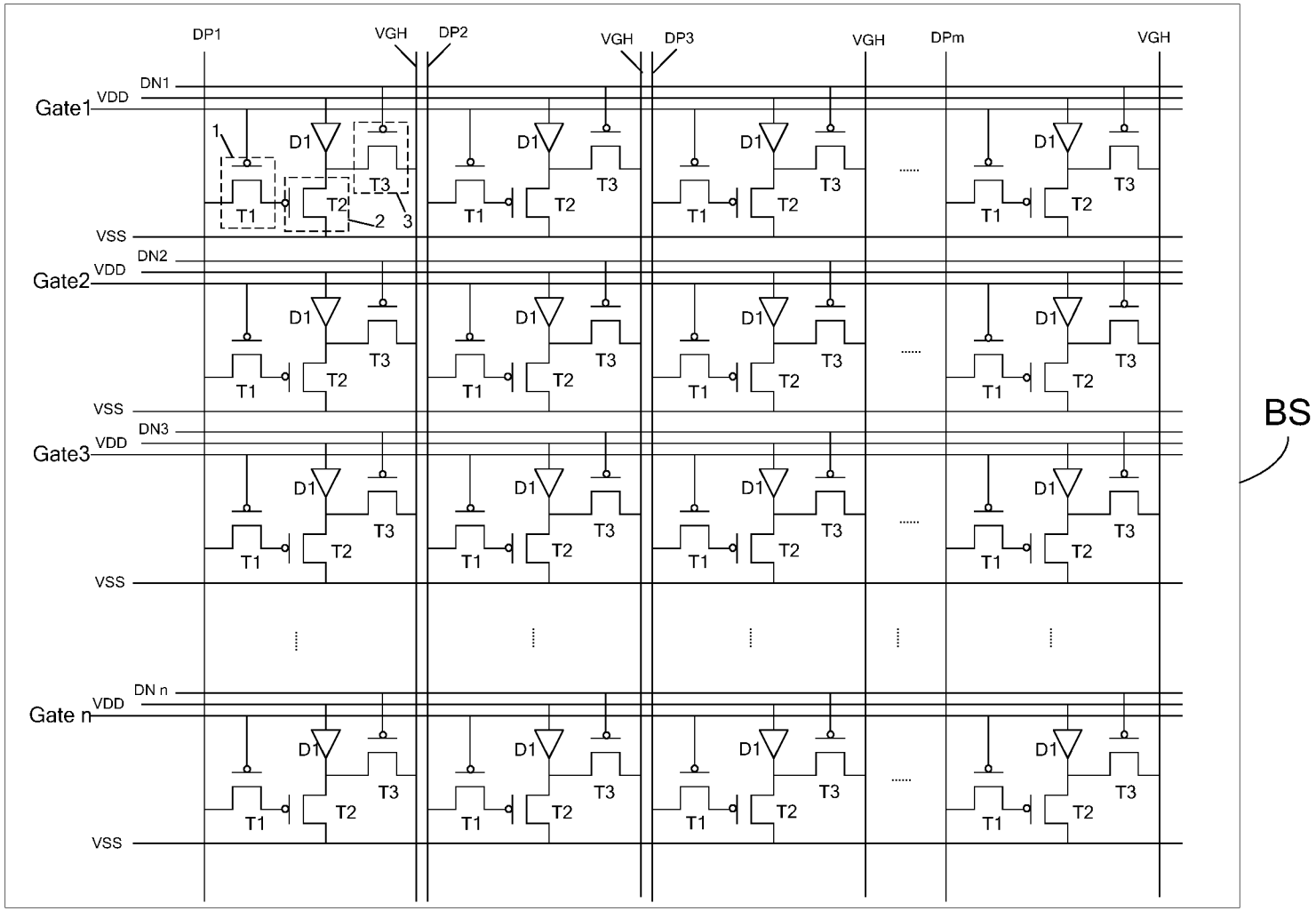
FIG. 5 is a schematic diagram illustrating a structure of a display panel according to an embodiment of the present disclosure.

In another aspect, the present disclosure provides a display panel. FIG. 5 is a schematic diagram illustrating a structure of a display panel according to an embodiment of the present disclosure. As illustrated in FIG. 5, the display panel in some embodiments includes a plurality of display signal lines (DP1 to DPm), a plurality of reset signal lines (DN1 to DNn), and a plurality of scan lines (Gate1 to Gaten). The plurality of display signal lines (DP1 to DPm) are provided to intersect the plurality of scan lines (Gate1 to Gaten) to define a plurality of pixel circuits by the intersections. Each of the pixel units has a pixel circuit provided therein, and the pixel circuit may be any one of the pixel circuits described herein. As illustrated in FIG. 5, the plurality of pixel circuits are arranged in an array having rows and columns, and the switching sub-circuits 1 of a same row of pixel circuits are electrically coupled to a same scan line (e.g., Gate1) of the plurality of gate lines, and the switching sub-circuits 1 of a same column of pixel circuits are electrically coupled to a same display signal line (e.g., DP1) of the plurality of display signal lines.

In addition, as illustrated in FIG. 5, the display panel further includes a base substrate BS, and the plurality of pixel circuits are arranged on the base substrate BS. Optionally, the base substrate BS is a glass substrate.

In the present display panel, the switching sub-circuits 1 of a same row of pixel circuits are electrically coupled to a same scan line and the switching sub-circuits 1 of a same column of pixel circuits are electrically coupled to a same display signal line. As such, the switching sub-circuits in a same row of pixel circuits are controlled to be turned on by progressively inputting scan signals to the scan lines, and the emission state of the light emitting diode D1 in the pixel circuit coupled to a display signal line is controlled based on the display signal input to the display signal line. Compared to the driving manner of the light emitting diodes in the existing display panel, the wirings can be reduced in the present display panel including the pixel circuits described herein, such that the narrow bezel design of the display panel can be achieved.

The pixel circuit in the present display panel may further include the reset sub-circuit 3. The reset sub-circuits 3 in a same row of pixel circuits are electrically coupled to a same reset signal line (e.g., DN1) and the reset sub-circuits 3 in a same column of pixel circuits are electrically coupled to a same restoration signal line (represented by VGH in FIG. 5). As such, the reset sub-circuits in a same row of pixel circuits may be controlled to be turned on by progressively inputting reset signals to the reset signal lines, and the light emitting diodes D1 coupled to a restoration signal line is restored through the restoration signal input to the restoration signal line so as not to emit light. In this manner, the wirings in the display panel may be further reduced.

Figure 6:
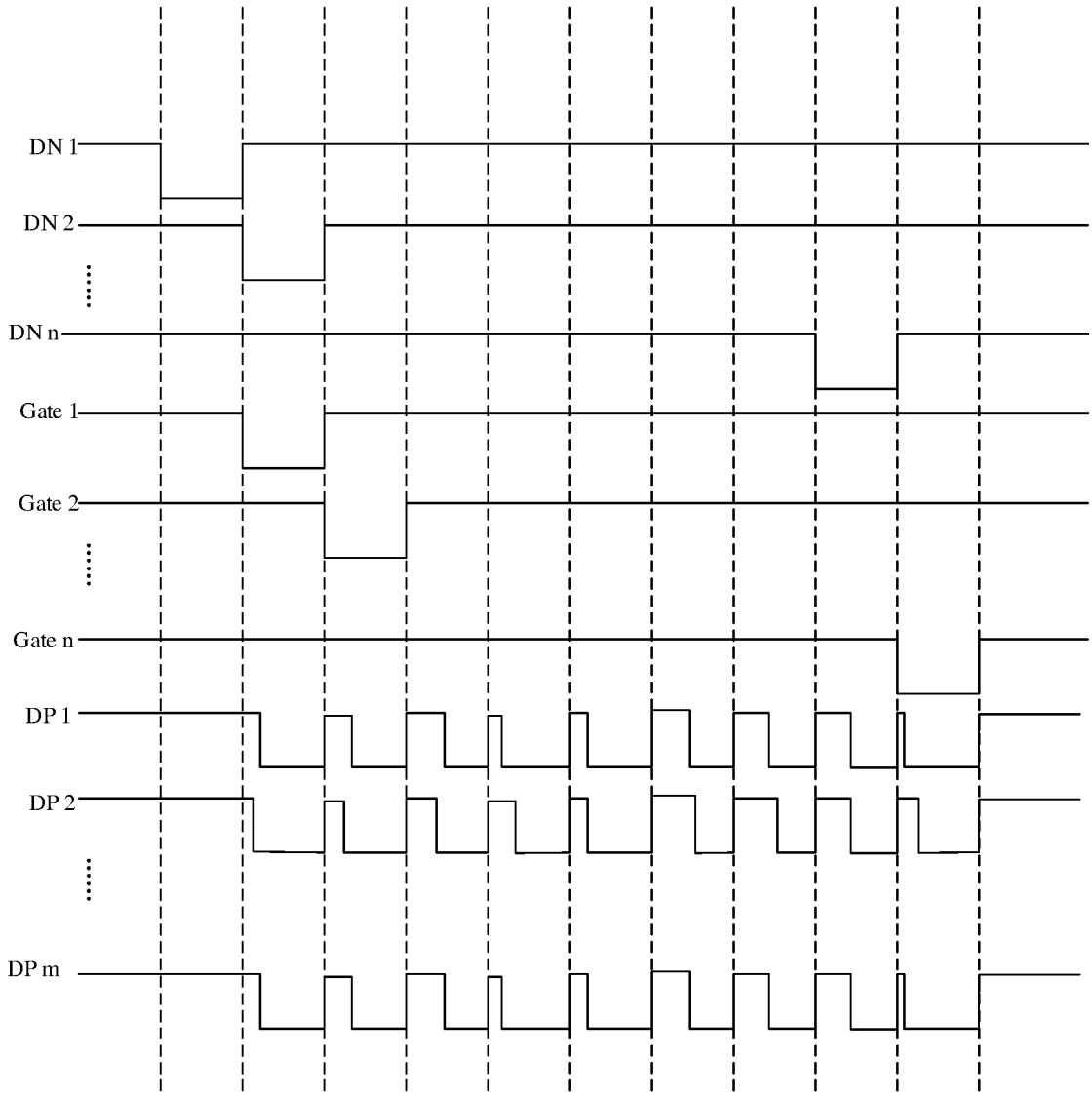
FIG. 6 is a timing sequence of an operation of the display panel in FIG. 5.

FIG. 6 is a timing sequence of an operation of the display panel in FIG. 5. The operating principle of each pixel circuit in FIG. 5 may refer to the descriptions made to the pixel circuits with reference to FIGS. 1 to 4 in above embodiments.

From FIG. 6 it can be seen that when the current row of pixel circuits are in the emission stage, the next row of pixel circuits are in the restoration stage. As such, the next row of pixel circuits start to emit light when the emission stage of the current row of pixel circuits is finished. In this driving manner, the timing sequence of the operation of the whole display panel is compact, thereby the refresh rate of the display panel can be effectively improved to improve the display performance of the display panel.

The display signals applied to the display signal lines (DP1 to DPm), which are schematically illustrated in FIG. 5, are merely for illustrating that the display signals applied to a same column of pixel circuits may be different in the emission stage. That is, different light emitting diodes D1 may have different grayscales and brightness, which is realized by controlling the pulse width and amplitude of the low voltage level signal input to the display signal line (i.e., effective time and magnitude of the display signal) in the emission stage.

In another aspect, the present disclosure further provides a video wall including a plurality of display panels, each of which is any one of the display panels described herein. The plurality of display panels are spliced together to form the video wall. By splicing the plurality of display panels together, a large size panel with a high resolution can be realized and the wirings thereof is less.

The display panel may include a product or part having display function such as an OLED panel, a mobile phone, a tablet computer, a television, a monitor, a laptop computer, a digital photo frame, a navigator or the like.

It is to be understood that the above embodiments are merely exemplary embodiments for the purpose of explaining the principles of the present disclosure, but the present disclosure is not limited thereto. Various modifications and improvements can be made by those skilled in the art without departing from the spirit and scope of the present disclosure. These modifications and improvements are also considered to be within the protection scope of the present disclosure.

What is claimed is:

1. A pixel circuit, comprising a light emitting diode, a switching transistor, an emission control transistor, and a reset transistor, wherein the light emitting diode has a first electrode configured to receive a first power supply voltage and a second electrode configured to receive a second power supply voltage, the light emitting diode is a mini light emitting diode, the first electrode is an anode and the second electrode is a cathode;

the switching transistor has a first electrode electrically coupled to a display signal terminal, a second electrode directly coupled to a control electrode of the emission control transistor and a control electrode electrically coupled to a scan signal terminal, and is configured to control an emission state of the light emitting diode based on a display signal provided from the display signal terminal, in response to a scan signal provided from the scan signal terminal, the emission control transistor has a first electrode directly coupled to the second electrode of the light emitting diode and a second electrode directly coupled to a second power supply voltage terminal, and is configured to couple a voltage provided from the second power supply voltage terminal as the second power supply voltage to the second electrode of the light emitting diode in response to the display signal, the reset transistor has a first electrode electrically coupled to a restoration signal terminal, a second electrode directly coupled to the second electrode of the light emitting diode and a control electrode electrically coupled to a reset signal terminal, and configured to couple a restoration signal provided from the restoration signal terminal to the second electrode of the light emitting diode in response to a reset signal provided from the reset signal terminal, wherein the emission state varies based on a magnitude and a duration of an effective voltage level of the display signal, wherein the first power supply voltage has a fixed high voltage level, and the second power supply voltage has a fixed low voltage level, wherein the restoration signal has a high voltage level higher than the first power supply voltage, and wherein the first electrode of the reset transistor is electrically disconnected from the control electrode of the emission control transistor and the second electrode of the switching transistor.

2. A display panel, comprising a plurality of scan lines and a plurality of display signal lines crossing over each other, and a plurality of pixel units defined by crossing points of the plurality of scan lines and the plurality of display signal lines, the plurality of pixel units being arranged in an array having rows and columns, and each of the plurality of pixel units having a pixel circuit provided therein, wherein the pixel circuit is the pixel circuit of claim 1, wherein switching transistors of a same row of pixel circuits of the plurality of pixel units are electrically coupled to a same scan line of the plurality of scan lines; and switching transistors of a same column of pixel circuits of the plurality of pixel units are electrically coupled to a same display signal line of the plurality of display signal lines.

3. The display panel of claim 2, further comprising a glass substrate, wherein pixel circuits of the plurality of pixel units are provided on the glass substrate.

4. A video wall formed by a plurality of display panels spliced together, wherein each of the plurality of display panels is the display panel of claim 2.

5. A method for driving a pixel circuit, the pixel circuit comprising a light emitting diode, a switching transistor, an emission control transistor and a reset transistor, the light emitting diode having a first electrode configured to receive a first power supply voltage and a second electrode configured to receive a second power supply voltage, the light emitting diode being a mini light emitting diode, the first electrode being an anode and the second electrode being a cathode, the switching transistor having a first electrode electrically coupled to a display signal terminal, a second electrode directly coupled to a control electrode of the emission control transistor and a control terminal electrically coupled to a scan signal terminal, the emission control transistor having a first electrode directly coupled to the second electrode of the light emitting diode and a second electrode directly coupled to a second power supply voltage terminal configured to provide the second power supply voltage, the reset transistor having a first electrode electrically coupled to a restoration signal terminal, a second electrode directly coupled to the second electrode of the light emitting diode and a control electrode electrically coupled to a reset signal terminal, wherein the method comprise:

turning on the switching sub-circuit through a scan signal provided from the scan signal terminal;

and controlling an emission state of the light emitting diode based on a display signal provided from the display signal terminal, wherein the emission state varies based on a magnitude and a duration of an effective voltage level of the display signal, wherein the first power supply voltage has a fixed high voltage level, and the second power supply voltage has a fixed low voltage level, wherein the restoration signal has a high voltage level higher than the first power supply voltage, and wherein the first electrode of the reset transistor is electrically disconnected from the control electrode of the emission control transistor and the second electrode of the switching transistor.

6. The method of claim 5, wherein the controlling the emission state of the light emitting diode based on the display signal provided from the display signal terminal comprises controlling a duration during which the emission control transistor is in on state based on the display signal to control the emission state of the light emitting diode.

7. The method of claim 6, further comprising:

turning on the reset sub-circuit through a reset signal provided from the reset signal terminal; and coupling a restoration signal provided from the restoration signal terminal to the second electrode of the light emitting diode to reset the light emitting diode.

* * * * *